US006727788B1

(12) United States Patent
Lawson et al.

(10) Patent No.: US 6,727,788 B1
(45) Date of Patent: Apr. 27, 2004

(54) LATCH MECHANISM FOR A CIRCUIT BREAKER

(75) Inventors: Robert P. Lawson, Snellville, GA (US); Andrew Hall, Lilburn, GA (US); William C. McCoy, Stone Mountain, GA (US); Stephen S. Thomas, Atlanta, GA (US); Ralph Leon Newton, Tucker, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/176,356

(22) Filed: Jun. 20, 2002

(51) Int. Cl.[7] ..... H01H 9/20
(52) U.S. Cl. ..... 335/167; 335/172; 335/21
(58) Field of Search ..... 335/21–25, 167–176

(56) References Cited

U.S. PATENT DOCUMENTS 3,748,609 A * 7/1973 Wallace et al. ..... 335/174
4,123,734 A * 10/1978 Maier et al. ..... 335/9
5,416,291 A * 5/1995 Venzke ..... 200/17 R
5,633,483 A * 5/1997 Oster et al. ..... 200/17 R
5,718,328 A * 2/1998 Faber et al. ..... 200/401
6,201,460 B1 3/2001 Winslett et al.
6,222,143 B1 4/2001 Lawson et al.

* cited by examiner

*Primary Examiner*—Lincoln Donovan
(74) *Attorney, Agent, or Firm*—Foley & Lardner

(57) ABSTRACT

An apparatus for operating a circuit breaker. The circuit breaker includes a housing, a cradle mounted in the housing and coupled to a handle and to a movable contact. The apparatus comprises a latch frame mounted in the circuit breaker housing. A latch roller is mounted on the cradle. A latch member is configured to selectively engage the latch roller and the latch member is rotatably coupled to the latch frame. A latch shaft assembly is rotatably mounted in the latch frame and selectively engaged by the latch member. Upon rotation of the latch shaft assembly, the latch shaft assembly will disengage from the latch member and cause the movable contact to move.

27 Claims, 8 Drawing Sheets

LATCH MECHANISM FOR A CIRCUIT BREAKER

BACKGROUND OF THE INVENTION

The present invention relates generally to the field of electrical circuit breakers, and more particularly to a latch mechanism for a circuit breaker.

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are several ways by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism; or auxiliary devices can be used to trip the circuit breaker thereby move the movable contact. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross- section and related elements are specifically selected for such current range resulting in a number of different circuit breakers for each current range. The tripping mechanism may be housed in the same housing as the operating mechanism and contacts or it may be housed in a separate housing coupled to the housing containing the operating mechanism and contacts.

In prior art circuit breakers, in order to test the operating mechanism of the circuit breaker, it was necessary to place the circuit breaker in an electrical circuit and test it in its overload conditions, since the trip mechanism activated the operating system. Such procedures were time consuming, and placed an unnecessary duty cycle burden on the components of the circuit breaker.

Prior art circuit breakers also can be associated with auxiliary devices such as an undervoltage relay, indicator switches, shunt trip device, an auto trip interlock capability and a test button capability and the like. Prior art circuit breakers typically were designed to have a specific auxiliary device associated with that circuit breaker and either mechanically or electrically coupled to the operating mechanism. Such arrangements required specially designed auxiliary devices for each rating of a given circuit breaker frame and did not facilitate interchange of auxiliary devices with other circuit breaker ratings.

Thus, there is a need for an apparatus for operating a circuit breaker during conditions other than an overload condition. There is also a need for an apparatus for operating a circuit breaker that will disengage the latching mechanism and cause the movable contact to move. There is also a need for a molded case circuit breaker that provides the ability to test and inspect the operation of the operating mechanism independent of a trip unit. Thus there is a need for a latch mechanism that has several features that allow the introduction of accessory devices to interact directly with the operating mechanism of different rated circuit breakers.

SUMMARY OF THE INVENTION

The present invention provides an apparatus for operating a circuit breaker. The circuit breaker includes a housing, a cradle mounted in the housing and coupled to a handle and to a movable contact. The apparatus comprises a latch frame mounted in the circuit breaker housing. A latch roller is mounted on the cradle. A latch member is configured to selectively engage the latch roller and the latch member is rotatably coupled to the latch frame. A latch shaft assembly is rotatably mounted in the latch frame and selectively engaged by the latch member. Upon rotation of the latch shaft assembly, the latch shaft assembly will disengage from the latch member and cause the movable contact to move. In one embodiment, a single latch spring is coupled to the latch shaft and the latch member. Another embodiment includes a kicker member mounted in a trip unit. The kicker member is configured to act upon a trip arm and to be moved to a reset position by the handle of the circuit breaker.

There is also provided an apparatus for operating a circuit breaker. The circuit breaker includes a housing, a cradle mounted in the housing and coupled to a handle and to a movable contact. The apparatus comprises a means for supporting mounted in the circuit breaker housing. A means for rolling is mounted in the cradle. A means for latching is configured to selectively engage the means for rolling and is rotatably coupled to the means for supporting. A means for rotating is rotatably mounted in the means for supporting. The rotation of the means for rotating will disengage the means from rotating from the means for latching and cause the movable contact to move.

There is further provided a molded case circuit breaker comprising a housing, an operating mechanism mounted in the housing. The operating mechanism has a cradle coupled to a handle and to a movable contact. An apparatus for operating the circuit breaker during a condition other than an overload condition is also included. The apparatus comprises a latch frame mounted in the circuit breaker housing. A latch roller mounted in the cradle. A latch member is configured to selectively engage the latch roller and is rotatably coupled to the latch frame. A latch shaft assembly is rotatably mounted in the latch frame and selectively engaged with the latch member. The rotation of the latch shaft assembly will disengage the latch shaft assembly from the latch member and cause the movable contact to move.

DETAILED DESCRIPTION OF THE EXEMPLARY EMBODIMENTS

Figure 1:
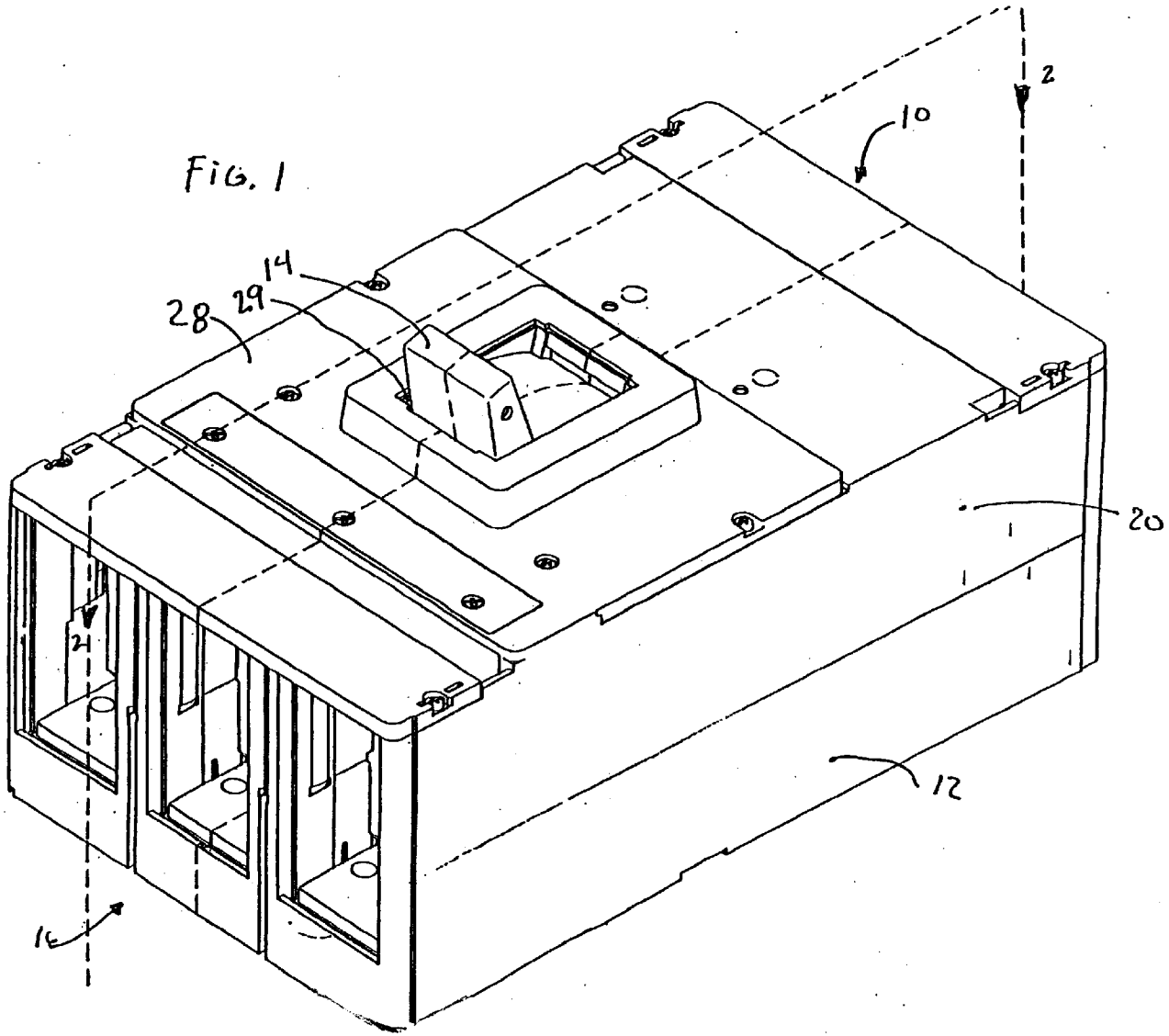
FIG. 1 is a perspective illustration of a molded case circuit breaker which includes an exemplary embodiment of a latch mechanism that will operate the circuit breaker during a condition other than an overload condition.

FIG. 1 generally illustrates a three phase molded case circuit breaker 10 of the type which includes an operating mechanism 40 having a pivoting member 13 with a handle 14. The pivoting member 13 and handle 14 are moveable between an "ON" position, an "OFF" position, and a "TRIPPED" position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
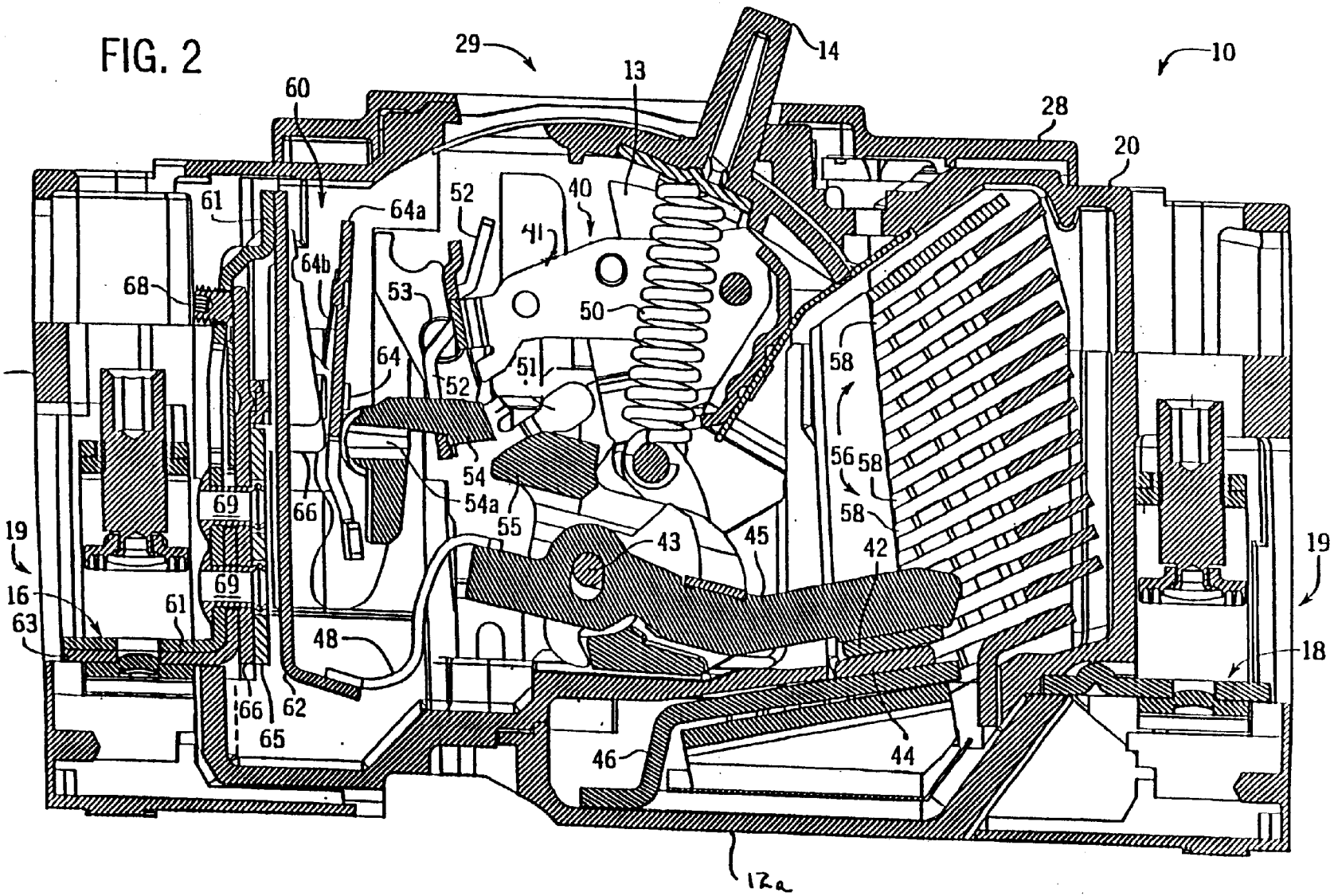
FIG. 2 is a sectional view of the circuit breaker shown in FIG. 1 along the line 2—2 and is used to describe a typical operation of the circuit breaker.

Referring to FIG. 2, there is illustrated an exemplary embodiment of a molded case circuit breaker having a handle 14 that is operable between the "ON" and "OFF" positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12*a*, a circuit breaker cover 20 and an accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages a latch mechanism 90 to hold the contacts of the circuit breaker in a closed position unless and until an over current condition occurs, which causes the circuit breaker to trip, or the latch is acted upon by a latch shaft assembly 100 as a result of a condition to be described below.

A portion of the moveable contact arm 45 and the stationary contact bus 46 are contained in an arc chamber 56. Each pole of the circuit breaker 10 is typically provided with an arc chamber 56 which is molded from an insulating material and is part of the circuit breaker 10 housing 12. A plurality of arc plates 58 is maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

During normal operation of the circuit breaker 10, current flows from the line terminal 18 through the line contact arm 46 and its stationary contact pad 44 to the load contact arm 45 through its contact pad 42. From the load contact arm 45, the current flows through a connector, for example a flexible braid, 48 to the bimetallic element 62 and from the bimetallic element 62 to the load terminal 16. (See FIG. 3) When the current flowing through the circuit breaker exceeds the rated current for the breaker, it heats the bimetallic element 62, causing the element 62 to bend towards a trip bar. If the over current condition persists, the bimetallic element 62 bends sufficiently to engage the trip bar surface. As the bimetallic element engages the trip bar surface and continues to bend, it causes the trip bar to rotate and thus unlatching the operating mechanism 40 of the circuit breaker. The trip can all be produced by an electronic trip mechanism that will trip the breaker when an overload condition is sensed.

Figure 3:
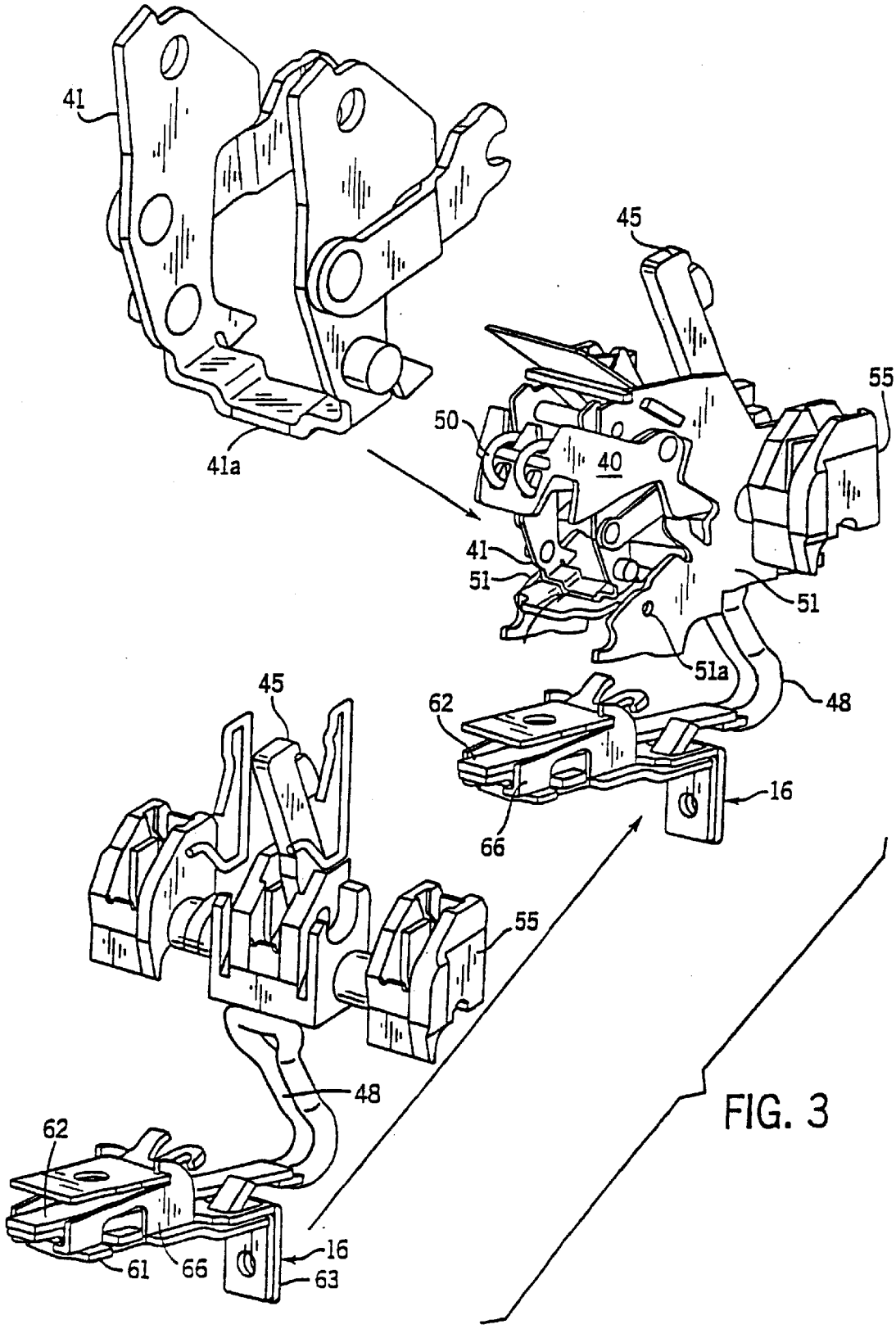
FIG. 3 is an exploded view of the operating mechanism, contact structure and an exemplary trip unit of the circuit breaker illustrated in FIG. 2.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bimetallic element 62 by a flexible conductor 48 (e.g. braided copper strand). As shown in FIG. 3, current flows from the flexible conductor 48 through the bimetallic element 62 to a connection at the top of the bimetallic element 62 which couples the current to the load terminal 16 through the load bus 61. The load bus 61 is supported by a load bus support 63. It should be noted that more than one flexible conductor 48 may be utilized or that a solid bus bar can be used.

In an exemplary embodiment of a circuit breaker 10, the cross bar 55 is coupled to the operating mechanism 40, which is held in place in the base or housing 12 of the molded case circuit breaker 10 by a mechanical frame 51. A principal element of the operating mechanism 40 is the cradle 41. As shown in FIG. 3, the cradle 41 includes a latch surface 41 a which engages the operating surface 118 of the center portion 110 of the latch mechanism 90. The latch mechanism 90 is held in place by latch pivot pins 98 which are on either side of the latch frame 92. In an exemplary embodiment of the circuit breaker, the two side members of the mechanism frame 51 support the operating mechanism 40 of the circuit breaker 10 and retain the operating mechanism 40 in the base 12*a* of the circuit breaker 10. The latch frame 92 is mounted on the mechanical frame 51.

Figure 4:
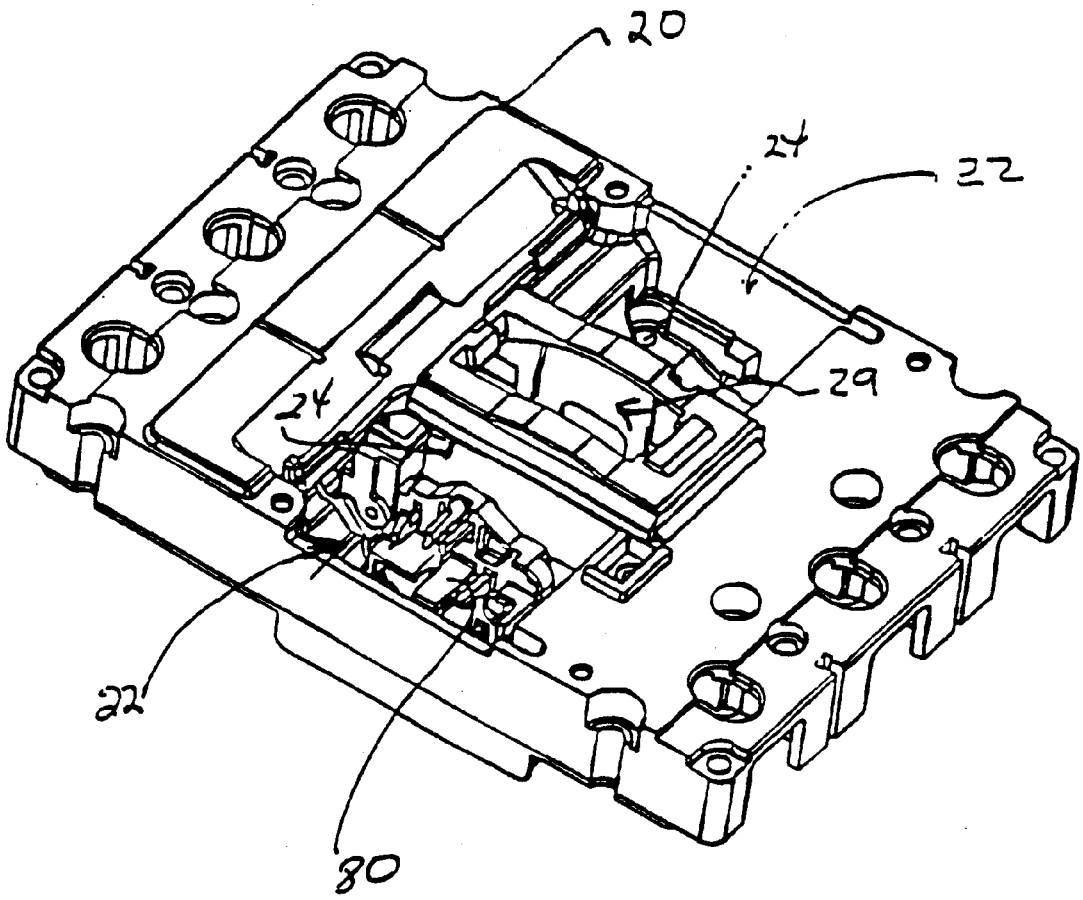
FIG. 4 is an illustration of an exemplary embodiment of a circuit breaker cover having an accessory pocket on each side of the handle opening in the cover.

FIG. 4 illustrates the breaker cover 20. The breaker cover 20, can have two accessory pockets 22 formed in the cover 20, with one accessory pocket 22 on either side of the opening 29 for the pivoting member 13 and handle 14. The breaker cover 20 with the accessory pockets 22 or compartments can be formed, usually by well known molding techniques, as an integral unit. The accessory pocket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory pocket or compartment 22 is provided with a plurality of openings 24. The accessory pocket openings 24 are positioned in the pocket 22 to facilitate coupling of an accessory 80 with the operating mechanism 40 mounted in the housing 12. The accessory pocket openings 24 also facilitate simultaneous coupling of an accessory 80 with different parts of the operating mechanism 40 and the latch shaft assembly 100. Various devices or accessories 80 associated with the circuit breaker 10 can be mounted in the accessory compartment 22 to perform various functions. Some accessories, such as a shunt trip, will trip the circuit breaker 10, upon receiving a remote signal, by pushing the latch shaft assembly, causing release of the latch mechanism 90 of the operating mechanism .40. The shunt trip has a member protruding through one of the openings in the accessory pocket 22 and engages the operating mechanism 40, via the latch shaft assembly 100. Another accessory, such as an auxiliary switch, provides a signal indicating the status of the circuit breaker 10, e.g. "on" or "off". When the auxiliary switch is nested in the accessory pocket 22, a member on the switch assembly protrudes through one of the openings 24 in the pocket 22 and is in engagement with the operating mechanism 40, typically the cross bar 55. Multiple switches can be nested in one accessory pocket 22 and each switch can engage the operating mechanism through a different opening 24 in the pocket 22.

Figure 5:
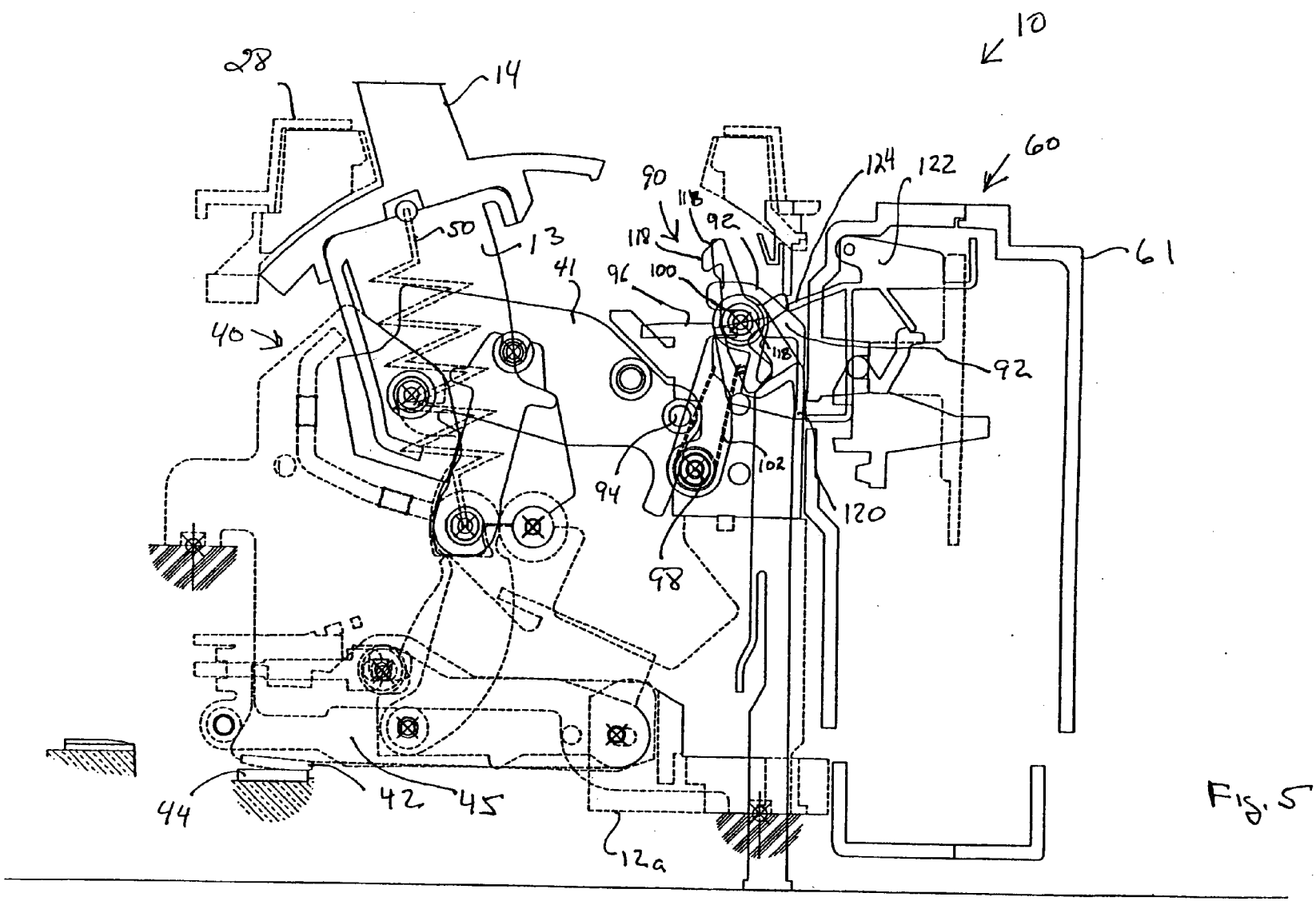
FIG. 5 is a partial illustration of a circuit breaker including an exemplary embodiment of a latch mechanism for operating the circuit breaker, with the circuit breaker in the "ON" position.
Figure 6:
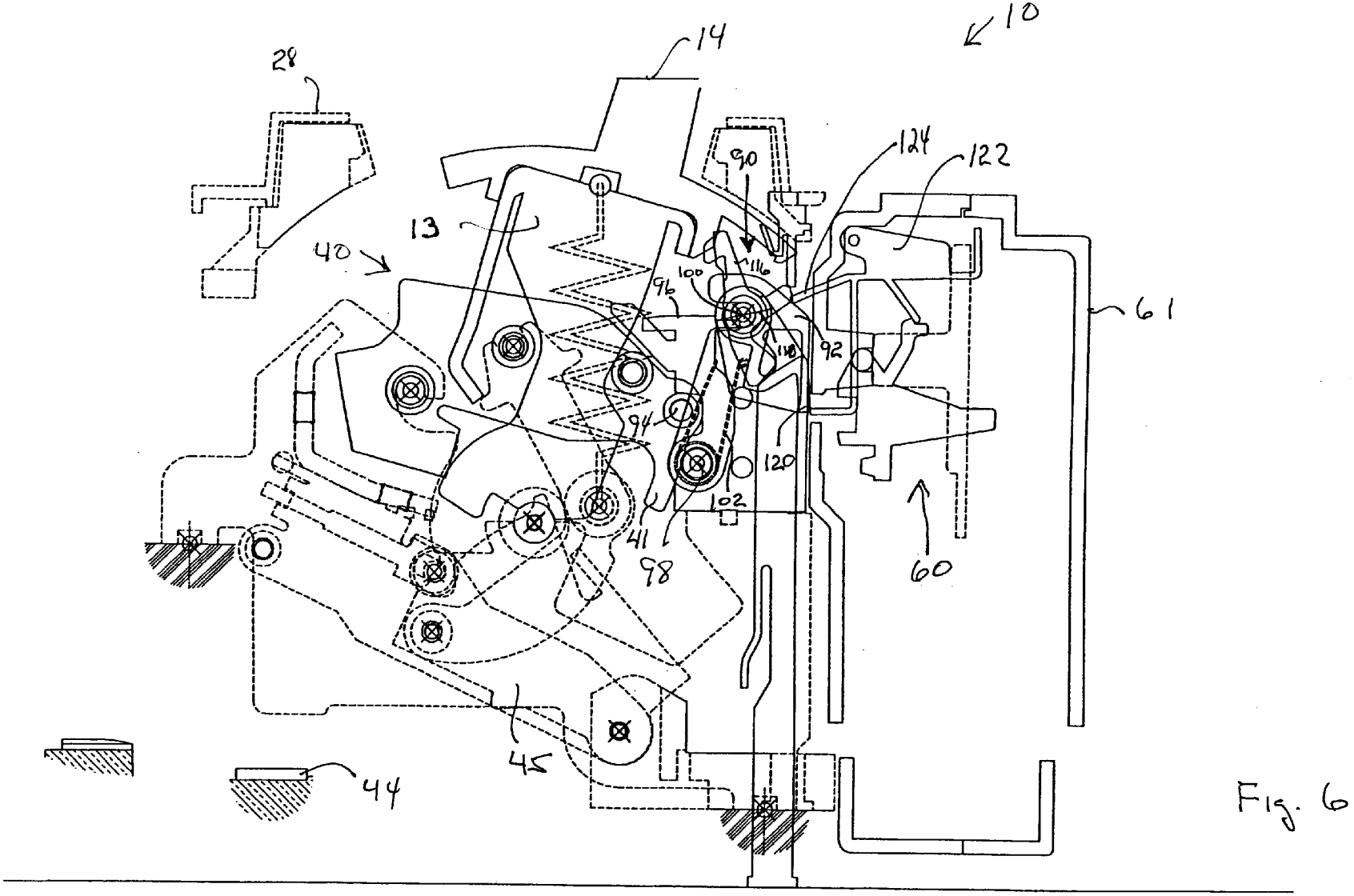
FIG. 6 is a partial illustration of a circuit breaker including an exemplary embodiment of a latch mechanism for operating the circuit breaker, with the circuit breaker in the "OFF" position.
Figure 7:
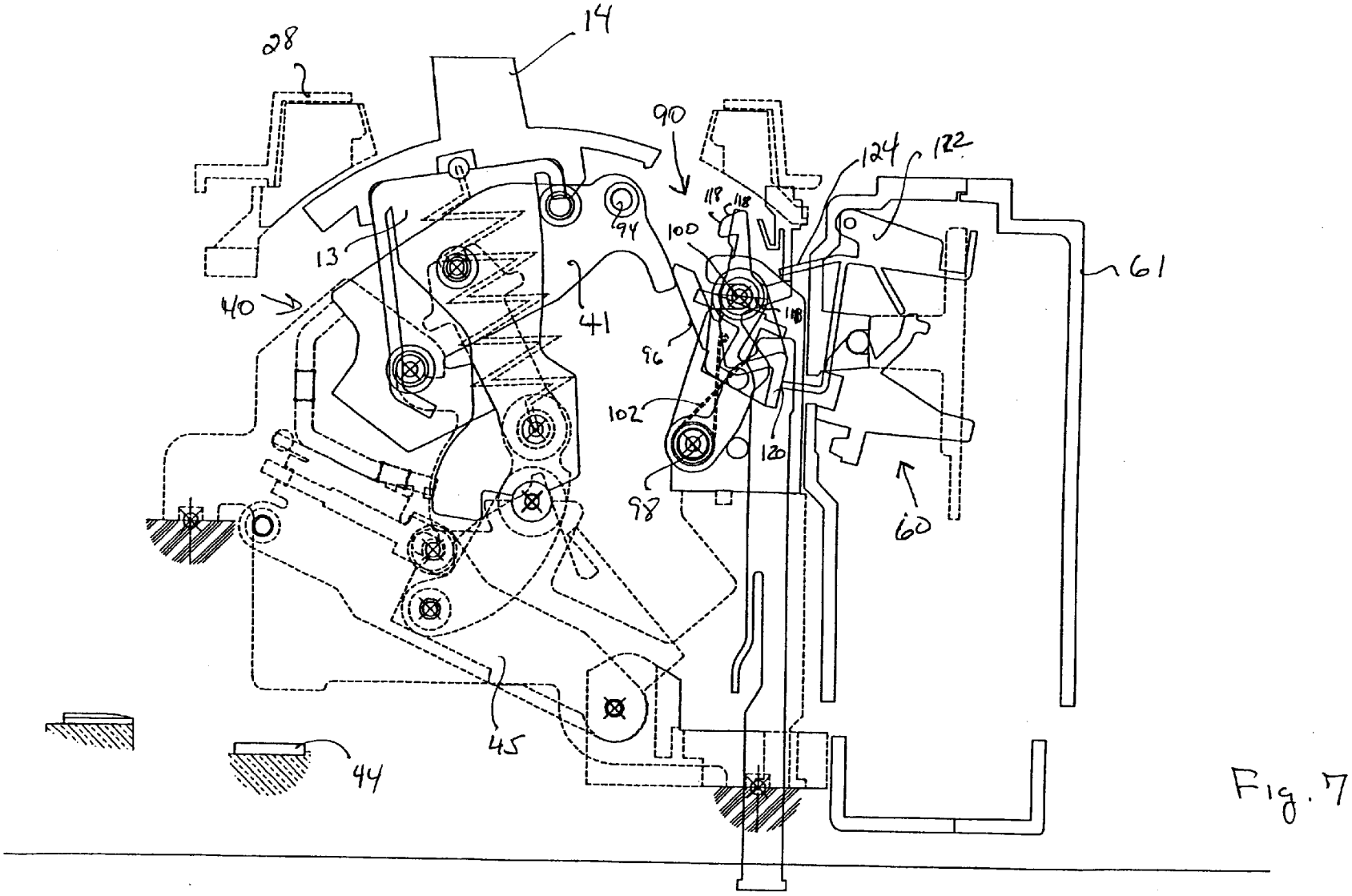
FIG. 7 is a partial illustration of a circuit breaker including an exemplary embodiment of a latch mechanism for operating the circuit breaker, with the circuit breaker in the "TRIPPED" position.

Referring now to FIGS. 5, 6 and 7, there is illustrated a partial sectional view of circuit breaker 10 in the "ON" position (FIG. 5), the "OFF" position (FIG. 6) and the "TRIPPED" position (FIG. 7).

In the figures, there is illustrated an exemplary embodiment of a latch mechanism, also referred to as an apparatus for operating a circuit breaker 90 with the apparatus comprising a latch frame 92 mounted in the circuit breaker housing 12. The latch frame 92 can be mounted on the mechanical frame 51 by any conventional and convenient method such as welding, riveting or bolting. The latch frame 92 is typically composed of metal but could be a suitable composite material. A latch roller 94 is mounted on the cradle 41 of the operating mechanism 40 of the circuit breaker 10. The latch roller 94 is a single piece that spans the width of the cradle 41 and seats underneath a surface of the latch member 96. The latch roller 94 can be composed of metal, a composite material or a combination of metal and composite material. The latch roller 94 can also be formed as an integral portion of the cradle 41. Note that the figures illustrate only one side of the cradle, an operating mechanism 40 of the circuit breaker 10. A latch member 96 is configured to selectively engage the latch roller 94 and is rotatably coupled to the latch frame 92 with a latch pivot pin 98.

During an ON/OFF operation of the handle 14 of the circuit breaker 10, the cradle 41 and the latch member 96 are maintained in substantially the same position as shown in FIGS. 5 and 6. In the "TRIPPED" position, the latch roller 94 moves along a surface of the latch member 96 as the cradle 41 extends into an upward position as depicted in FIG. 7.

The exemplary latch member 96 is generally has an upper portion which includes a latch surface that engages the cradle 41 and a lower portion having a latch surface which engages a latch shaft assembly 100. The center portion of the latch member 96 is angled with respect to the upper and lower portion and includes two tabs which provide a pivot edge for the latch member 96 when it is inserted into the latch frame 92. As shown in FIGS. 5–7, the latch member 96 is coupled to a torsion latch spring 102 which is mounted on the latch shaft 104. The torsion latch spring 102 biases the latch member 96 toward the cradle 41 while at the same time biasing the latch shaft assembly 100 into a position which engages the lower surface of the latch member 96. The latch shaft assembly 100 pivots in a clockwise direction about an axis, responsive to a force exerted by a trip mechanism 60, during, for example, a long duration overcurrent condition. As latch shaft assembly 100 rotates, the operations surface 118 on the center portion 110 of the shaft 104 disengages the latch surface on the latch member 96. When this latch surface of the latch member 96 is disengaged, the latch member 96 rotates in a under the force of the operating mechanism 40, exerted through a cradle 41 by the latch roller 94. In the exemplary circuit breaker, this force is provided by a tension spring 50. Tension is applied to the spring when the breaker handle 14 is moved from the open position to the closed position. More than one tension spring 50 may be utilized.

As the latch member 96 rotates responsive to the upward force exerted by the cradle 41, it releases the latch member on the operating mechanism 40, allowing the cradle 41 to rotate. When the cradle 41 rotates, the operating mechanism 40 is released and the cross bar 55 rotates to move the movable contact arms 45 away from the stationary contact 44.

A latch shaft assembly 100 is rotatably mounted in the latch frame 92 and selectively engages with the latch member 96. The latch member 96 is held in place by the operating surface 118 of the center portion 110 of the latch shaft assembly 100. When the latch shaft assembly 100 rotates it will disengage the latch shaft assembly 100 from the latch member 96 with the latch member 96 rotating to the right (counter-clockwise) as illustrated in FIG. 7 to release the cradle 41 which causes the operating mechanism 40 to move the movable contact arm 45 in an upward motion which separates the movable contact 42 from stationary contact 44 which in turn breaks the electrical circuit in which the circuit breaker 10 is placed.

A latch spring 102 is coupled to the latch shaft 100 and the latch member 96. The latch spring 102 biases the latch shaft assembly 100 as well as the latch member 96 as described above. The latch spring 102 can be a torsion spring which is wound around the shaft 104 of a latch shaft assembly 100.

Figures 8, 8A:
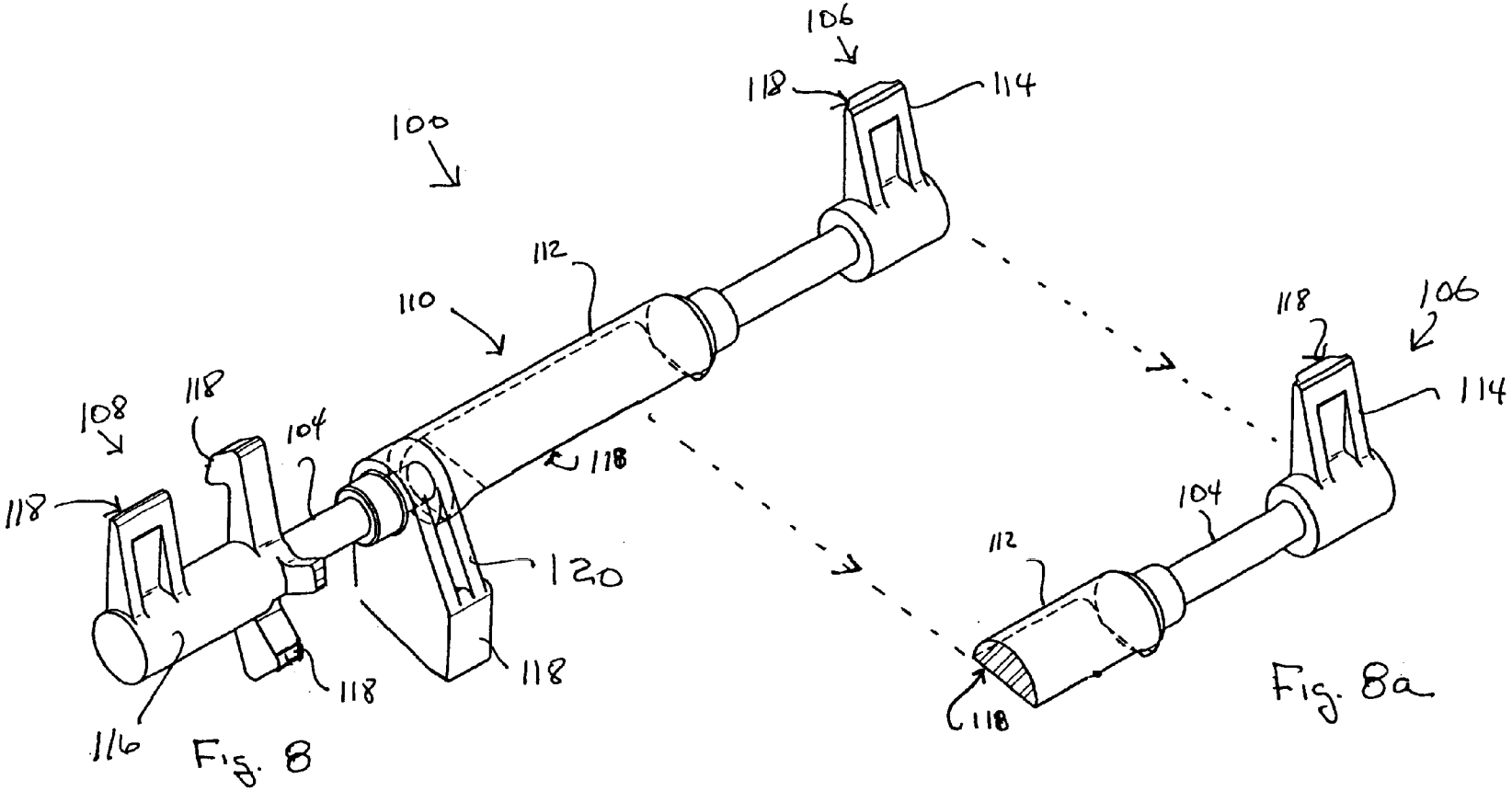
FIG. 8 is a perspective view of an exemplary embodiment of a latch shaft assembly used in the circuit breaker illustrated in FIGS. 5–7.
FIG. 8*a* is a partial perspective sectional view of the latch shaft assembly shown in FIG. 8 illustrating the configuration of the center portion of the latch shaft assembly.

As shown in FIGS. 8 and 8*a*, the latch shaft assembly 100 includes a metal shaft 104 with a center portion 110. A first molded member 114 is mounted on at least one end 106 of the shaft 104 with the first molded member 114 including an operating surface 118 configured to engage a device 80 associated with the circuit breaker 10. The illustrated embodiment shows a molded member on each end of the shaft.

Another embodiment provides that the shaft 104 includes a second molded member 116 on another end 108 of the shaft 104. The second molded member 116 includes an operating surface 118 configured to engage another device 80 associated with the circuit breaker 10. The center portion 110 of the latch shaft assembly 100 is configured in a D-shape as shown in FIG. 8*a*. The D-shape portion 110 can be a molded element 112 mounted on the shaft 104. The shaft 104 can be metal or other suitable material that is configured to withstand the forces and temperatures typically experienced by a circuit breaker 10. The operating surface 118 of the center portion 110 of the latch shaft assembly 100 engages the operating surface of the latch member 96 and holds it in a "cocked" condition. When the trip mechanism 60 of the circuit breaker 10 senses an overload, a kicker member 122 moves a kicker extension 124 which contacts the trip arm 120 which is mounted in the center portion 110 of the latch 104 of the latch shaft assembly 100. (See FIGS. 8 and 7).

The trip arm 120 is aligned with the trip mechanism 60 associated with the circuit breaker 10 and is configured to be acted upon by the trip mechanism 60 to trip the circuit breaker 10. The trip mechanism 60 also includes the above mentioned kicker member 122 which is pivotally mounted in the trip mechanism 60 and is configured to act upon the trip arm 120. The kicker member 122 and specifically a kicker extension 124 is configured to be moved to a reset position by the handle 14 of the circuit breaker. Movement of the handle 14 against the extension 124 of the kicker member 122 moves the kicker back into alignment with the trip mechanism 60 as can be seen in FIGS. 6 and 7.

The latch frame 92 is the means for supporting the latch member 96 within the circuit breaker housing 12. The apparatus for operating the circuit breaker 90 allows the circuit breaker to be operated during a condition other than an overload condition. As mentioned above, the trip mechanism 60 of the circuit breaker 10 will trip the circuit breaker when it senses an overload condition either through a bi-metal element 62 or a magnetic amplifier which is part of the trip mechanism 60 in the trip housing 61. However, various devices associated with the circuit breaker 80 can also trip the circuit breaker 10. Such devices 80 are placed in accessory pockets 22 and align with the various operating surfaces 118 located on the latch shaft assembly 100 through various accessory pocket openings 24 in the cover 20 of the circuit breaker. A signal can be sent to one of the accessory devices 80 which will then act upon one of the operating surfaces 118 of the latch shaft assembly 100. The shaft in turn will rotate the latch shaft assembly 100 and disengage the latch member 96 allowing the cradle 41 to rotate up and cause the movable contact arm 45 to break the electrical circuit. The cradle is biased in an upward direction by the spring 50 as previously described. The latch spring 102 maintains the proper rotational relationship between the latch member 96 and the latch shaft assembly 100.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example, it is also contemplated that the trip mechanism having a bi-metal trip unit or an electronic trip unit with a load terminal be housed in a separate housing capable of mechanically and electrically connecting to another housing containing the operating mechanism and line terminal, thereby providing for a quick and easy change of current rating for an application of the circuit breaker contemplated herein. Modifications will be evident to those with ordinary skill in the art.

What is claimed is:

1. An apparatus for operating a circuit breaker, circuit breaker including a housing, a cradle mounted in the housing and coupled a handle and to a movable contact, the apparatus comprising:

a latch frame mounted in the circuit breaker housing;

a latch roller mounted in the cradle;

a latch member configured to selectively engage the latch roller and rotatably coupled to the latch frame; and a latch shaft assembly rotatably mounted in the latch frame and selectively engaged with the latch member, wherein the rotation of the latch shaft assembly will disengage the latch shaft assembly from the latch member and cause the movable contact to move.

2. The apparatus of claim 1, including a latch spring coupled to the latch shaft and the latch member.

3. The apparatus of claim 1, wherein the latch shaft assembly includes a metal shaft with a center portion and a first molded member on at least one end of the shaft, with the first molded member including an operating surface configured to engage a device associated with the circuit breaker.

4. The apparatus of claim 3, including a second molded member on another end of the shaft, with the second molded member including an operating surface configured to engage another device associated with the circuit breaker.

5. The apparatus of claim 3, wherein the center portion of the latch shaft assembly is configured in a D-shape.

6. The apparatus of claim 5, wherein the D-shape portion is a molded element mounted on the metal shaft.

7. The apparatus of claim 3, including an trip arm mounted in the center portion of the shaft.

8. The apparatus of claim 7, wherein the trip arm is aligned with a trip mechanism associated with the circuit breaker and configured to be acted upon by the trip mechanism to trip the circuit breaker.

9. The apparatus of claim 8, including kicker member mounted in the trip mechanism and configured to act upon the trip arm and to be moved to reset by the handle of the circuit breaker.

10. An apparatus for operating a circuit breaker, circuit breaker including a housing, a cradle mounted in the housing and coupled a handle and to a movable contact, the apparatus comprising:

a means for supporting mounted in the circuit breaker housing;

a means for rolling mounted in the cradle;

a means for latching configured to selectively engage the means for rolling and rotatably coupled to the means for supporting; and a means for rotating rotatably mounted in the means for supporting, wherein the rotation of the means for rotating will disengage the means for rotating from the means for latching and cause the movable contact to move.

11. The apparatus of claim 10, including a means for biasing mounted on the means for rotating and the means for latching.

12. The apparatus of claim 10, wherein the means for rotating includes a metal shaft with a center portion and a first means for engaging on at least one end of the shaft, with the first means for engaging including an operating surface aligned with a device associated with the circuit breaker.

13. The apparatus of claim 12, including a second means for engaging on another end of the shaft, with the second means for engaging including an operating surface aligned with another device associated with the circuit breaker.

14. The apparatus of claim 12, wherein the center portion of the means for rotating is configured in a D-shape.

15. The apparatus of claim 14, wherein the D-shape portion is a molded element mounted on the metal shaft.

16. The apparatus of claim 12, including an means for engaging mounted in the center portion of the shaft.

17. The apparatus of claim 16, wherein the means for engaging is aligned with a means for tripping associated with the circuit breaker and configured to be acted upon by the means for tripping to trip the circuit breaker.

18. The apparatus of claim 17, including means for kicking mounted in the means for tripping and configured to act upon the means for engaging and to be moved to reset by the handle of the circuit breaker.

19. A molded case circuit breaker comprising:

a housing;

an operating mechanism mounted in the housing, with the operating mechanism having a cradle coupled to a handle and to a movable contact; and an apparatus for operating the circuit breaker during a condition other than an overload condition, the apparatus comprising:

a latch frame mounted in the circuit breaker housing;

a latch roller mounted in the cradle;

a latch member configured to selectively engage the latch roller and rotatably coupled to the latch frame; and a latch shaft assembly rotatably mounted in the latch frame and selectively engaged with the latch member, wherein the rotation of the latch shaft assembly will disengage the latch shaft assembly from the latch member and cause the movable contact to move.

20. The molded case circuit breaker of claim 19, including a latch spring coupled to the latch shaft and the latch member.

21. The molded case circuit breaker of claim 19, wherein the latch shaft assembly includes a metal shaft with a center portion and a first molded member on at least one end of the shaft, with the first molded member including an operating surface configured to engage a device associated with the circuit breaker.

22. The molded case circuit breaker of claim 21, including a second molded member on another end of the shaft, with the second molded member including an operating surface configured to engage another device associated with the circuit breaker.

23. The molded case circuit breaker of claim 21, wherein the center portion of the latch shaft assembly is configured in a D-shape.

24. The molded case circuit breaker of claim 23, wherein the D-shape portion is a molded element mounted on the metal shaft.

25. The molded case circuit breaker of claim 21, including an trip arm mounted in the center portion of the shaft.

26. The molded case circuit breaker of claim 25, wherein the trip arm is aligned with a trip mechanism associated with the circuit breaker and configured to be acted upon by the trip mechanism to trip the circuit breaker.

27. The molded case circuit breaker of claim 26, including kicker member mounted in the trip mechanism and configured to act upon the trip arm and to be moved to reset by the handle of the circuit breaker.

* * * * *